US009947453B2

(12) United States Patent
Ono et al.

(10) Patent No.: US 9,947,453 B2
(45) Date of Patent: Apr. 17, 2018

(54) STATIONARY INDUCTION ELECTRIC APPARATUS

(71) Applicant: Hitachi, Ltd., Chiyoda-ku, Tokyo (JP)

(72) Inventors: Yasunori Ono, Tokyo (JP); Akira Nishimizu, Tokyo (JP); Naoya Miyamoto, Tokyo (JP); Kohei Yamaguchi, Tokyo (JP); Akira Yamagishi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 81 days.

(21) Appl. No.: 15/018,945

(22) Filed: Feb. 9, 2016

(65) Prior Publication Data

US 2016/0247621 A1 Aug. 25, 2016

(30) Foreign Application Priority Data

Feb. 20, 2015 (JP) ..... 2015-031246

(51) Int. Cl.

| | |
|---|---|
| ***H01F 27/10*** | (2006.01) |
| ***H01F 21/02*** | (2006.01) |
| ***H01F 27/12*** | (2006.01) |
| ***H01F 27/32*** | (2006.01) |

(52) U.S. Cl.
CPC ..... *H01F 27/12* (2013.01); *H01F 27/322* (2013.01); *H01F 27/323* (2013.01)

(58) Field of Classification Search
CPC ..... H01F 27/085; H01F 27/10; H01F 27/12; H01F 27/08; H01F 27/20; H01F 27/231
USPC ..... 336/55, 57, 58, 60
See application file for complete search history.

(56) References Cited

U.S. PATENT DOCUMENTS 2,912,658 A * 11/1959 Paluev ..... H01F 27/322 336/58
4,028,653 A * 6/1977 Carlsson ..... H01F 27/12 336/60
4,151,433 A * 4/1979 Flick ..... H02K 3/00 310/54
4,363,012 A * 12/1982 Daikoku ..... H01F 27/08 336/185
4,547,688 A * 10/1985 Hammer ..... H02K 9/00 310/260
4,568,900 A * 2/1986 Agatsuma ..... H01F 6/06 174/15.5

(Continued)

FOREIGN PATENT DOCUMENTS

EP 0 785 560 A1 7/1997
JP 7-14723 A 1/1995

(Continued)

*Primary Examiner* — Alexander Talpalatski
*Assistant Examiner* — Joselito Baisa
(74) *Attorney, Agent, or Firm* — Crowell & Moring LLP

(57) ABSTRACT

A stationary induction electric apparatus includes an iron core having legs of core and yokes of core; windings wound around the legs of core; coolant for cooling the windings; a cylindrical insulation structure that forms a flow of the coolant around the windings; baffle members alternately provided on the inner wall side and the outer wall side of the cylindrical insulation structure; and adjustment members for constricting the flow of the coolant. The adjustment members are provided on the same side of the respective baffle members and on the respective baffle members.

2 Claims, 12 Drawing Sheets

(56) References Cited

U.S. PATENT DOCUMENTS

| | | | | | |
|---|---|---|---|---|---|
| 5,138,294 | A * | 8/1992 | Yoshikawa | H01F 27/085 | 174/16.1 |
| 5,296,829 | A * | 3/1994 | Kothmann | H01F 27/322 | 336/185 |
| 5,444,426 | A * | 8/1995 | Sokai | H01F 27/322 | 336/57 |
| 5,448,215 | A * | 9/1995 | Sokai | H01F 27/322 | 336/57 |
| 5,508,672 | A * | 4/1996 | Sokai | H01F 27/322 | 336/57 |
| 5,651,175 | A * | 7/1997 | Grimes | H01F 27/322 | 29/602.1 |
| 6,577,027 | B2 * | 6/2003 | Hayase | H01F 27/10 | 310/52 |
| 2001/0052835 | A1 * | 12/2001 | Ito | H01F 27/322 | 336/57 |

FOREIGN PATENT DOCUMENTS

| | | | |
|---|---|---|---|
| JP | 9-199345 | A | 7/1997 |
| JP | 2012-119639 | A | 6/2012 |

* cited by examiner

STATIONARY INDUCTION ELECTRIC APPARATUS

BACKGROUND OF THE INVENTION

1. Field of the Invention

The present invention relates to a stationary induction electric apparatus such as a transformer or an iron-core reactor, and in particular, to a winding cooling structure.

2. Description of the Related Art

In a stationary induction electric apparatus configured of an iron core, a winding wound around the leg of core, and a plurality of cylindrical insulation structures, heat generated by electrification in the winding is transmitted to the coolant circulating around, and is discharged to the outside air or the like from a radiator or the like. This means that the winding is cooled. There are a case where coolant is forcibly circulated by a pump or the like (hereinafter referred to as forced convection) and a case where coolant circulates due to a temperature rise in the coolant around the winding (hereinafter referred to as natural convection).

In the case where a wire is wound a large number of times to constitute a winding, there is a structure in which the wire is arranged adjacently in a radial direction to produce a disk-like winding element (hereinafter referred to as a coil), and a plurality of them are arranged in an axial direction. In the case of cooling such a winding, as the flow velocity of the coolant differs depending on the position of the wire constituting the coil, heat transmission from the wire to the coolant may differ depending on the position.

In order to make heat transmission uniform in a circumferential direction of the coil mainly, there is a method in which a flow in vertical ducts (flow channel) formed between the winding and cylindrical insulation structures arranged on both sides thereof is sealed so as to form an almost zigzag flow from the inner side to the outer side or from the outer side to the inner side of the winding.

However, in the case of cooling the winding, as described, above, by natural convection, as the flow velocity of the circulating coolant is lower compared with the case of forced convection, there is a problem that the flow velocity of the coolant is likely to vary in the vicinity of respective portions of the winding. In order to cool the winding efficiently, it is desirable to make the flow velocity of the coolant uniform in respective portions of the winding.

As background art of the present technical field, there is JP-07-014723-A. JP-07-014723-A describes a structure in which in a winding having interval spacer plates for sealing the flow in a vertical flow channel to form a zigzag flow, the interval space plates are provided at narrower intervals in the upper portion of the winding and at wider intervals in the lower portion of the winding. There is also JP-2012-119639-A. JP-2012-119639-A describes a structure in which a transformer winding is divided into two, and blockage plates for blocking inner and outer side vertical channels and releasing the center vertical cooling channel and blockage plates for blocking the center vertical cooling channel are alternately arranged in an axial direction. There is also JP-09-199345-A. JP-09-199345-A describes a structure in which a flow dividing plate is provided to narrow the flow channel in the game direction as the downstream side of the opening of a baffle, and on the downstream side of the flow dividing plate, a flow return plate is provided on the vertical duct side opposite to the opening.

SUMMARY OF THE INVENTION

In the structure of JP-07-014723-A, when the upper and lower temperature difference in the coolant is large as in the case of using a gas as coolant, as it is possible to largely change a distance between interval spacers from the bottom to the top, good cooling can be made. However, when the upper and lower temperature difference in the coolant is small as in the case of using oil as coolant, as a distance between interval spacers is required to be narrower in the entire winding, it is difficult to achieve such an effect.

In the structure of JP-2012-119639-A, as zigzag flows are formed on both the inner diameter side and the outer diameter side of the winding, cooling is performed in a more uniform manner. However, a center vertical cooling channel for dividing the winding into two in a radial direction is required, causing a problem that the winding becomes larger.

In the structure of JP-09-199345-A, when a gas is used as coolant, it is possible to make the particular flow uniform to thereby achieve good cooling by the effects ox a flow dividing plate and a flow return plate. However, when another coolant such as oil is used, the flow differs from that of a gas, causing a problem that a sufficient effect cannot be achieved.

Embodiments of the present invention have been made in view of the above problems. An object of the present embodiments is, in a stationary induction electric apparatus in which a winding is cooled by natural convection, to make the flow velocity of coolant uniform in the vicinity of respective portions of the winding to thereby perform cooling of the winding efficiently.

To solve the above described problem, a stationary induction electric apparatus includes; an iron core having legs of core and yokes of core; windings (1) wound around the legs of core; coolant for cooling the windings (1); a cylindrical insulation structure (2*a*, 2*b*) that forms a flow of the coolant around the windings (1); baffle members (6*a*, 6*b*, 6*c*) alternately provided on the inner wall side and the outer wall side of the cylindrical insulation structure (2*a*, 2*b*); and adjustment members for constricting the flow of the coolant, the adjustment members (8*a*, 8*b*) being provided on the same side of the respective baffle members (6*a*, 6*b*, 6*c*) and on the respective baffle members.

By making the flow velocity of the coolant uniform in horizontal ducts in an area between neighboring baffles, it is possible to make the temperature rise uniform in respective portions of the winding, whereby an effect of efficient cooling can be achieved.

DESCRIPTION OF THE PREFERRED EMBODIMENTS

Embodiments will be described below with use of the drawings.

First Embodiment

In the present embodiment, an example of a self-cooling oil-filled single-phase transformer will be described.

Figure 1:
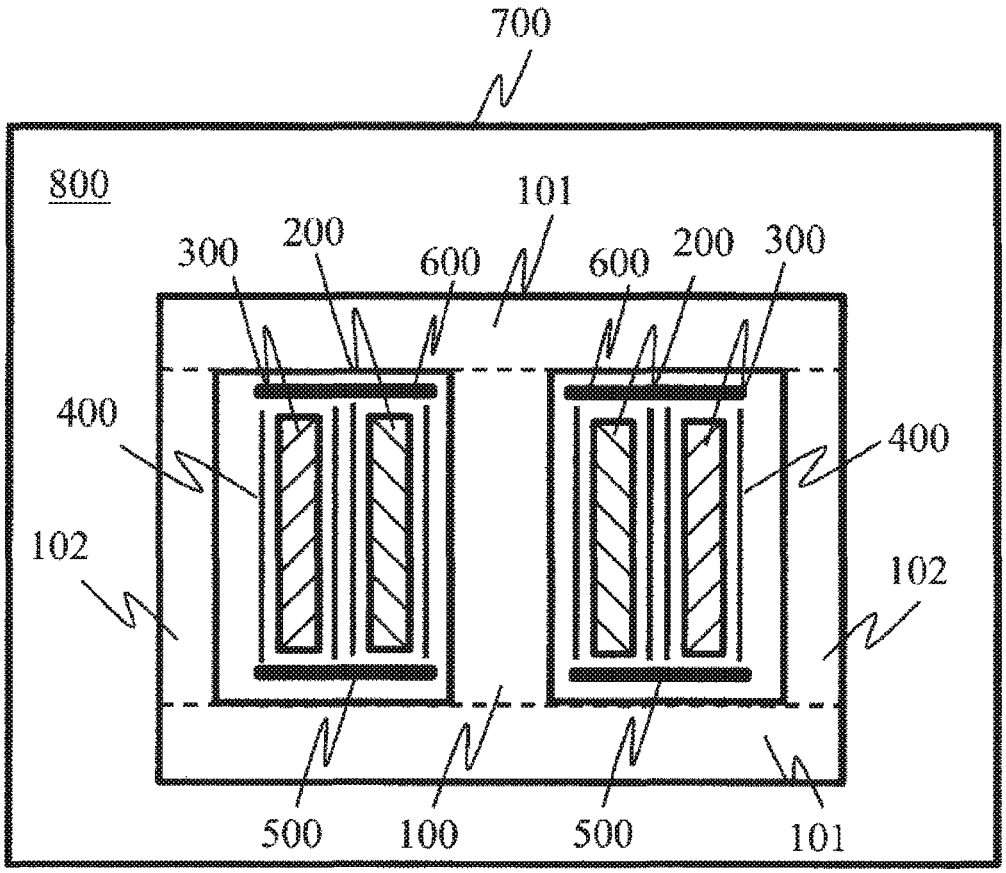
FIG. 1 is a vertical sectional view illustrating a schematic structure of a transformer.

FIG. 1 is a vertical sectional view illustrating a schematic structure of the transformer. An iron core is configured of a main leg of core 100, a yoke of core 101, and a side leg or core 102. The main leg of core 100 has a low voltage winding 200 and a high voltage wincing 300 wound thereon. The windings are arranged between cylindrical insulation structures 400, and are fixed by a lower insulation structure 500 and an upper insulation structure 600.

The iron core and the windings are housed in a tank 700, and insulation and cooling are provided by mineral oil 800 filling the tank 700. The tank 700 is linked to a radiator (not shown), and the heat generated in the transformer is conveyed to the radiator due to circulation of the mineral oil, and is discharged to the outside air.

Figure 2:
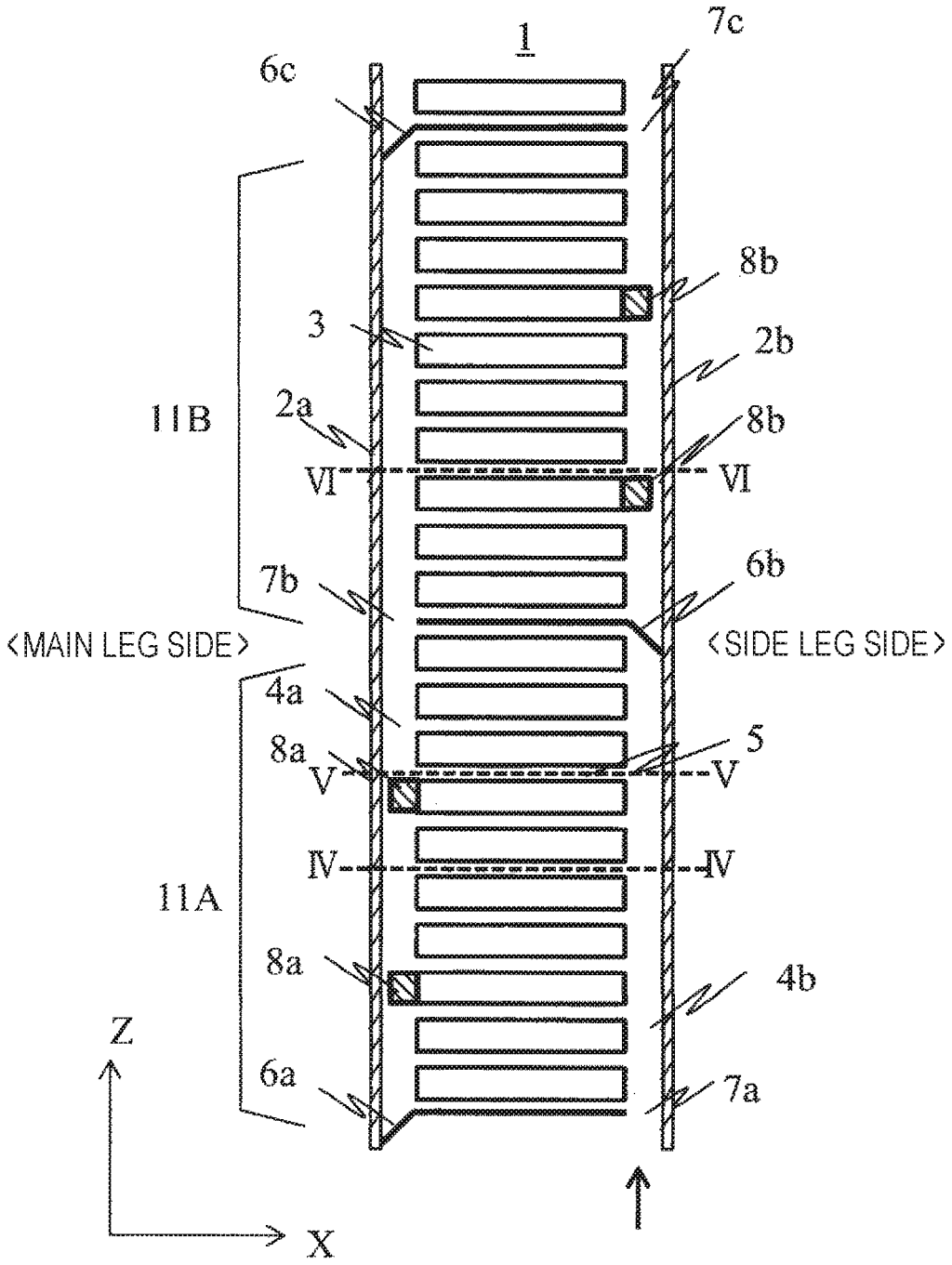
FIG. 2 is a vertical sectional view illustrating a winding cooling structure according to a first embodiment.

FIG. 2 is a vertical sectional view illustrating a winding cooling structure (for example, high voltage winding 300). A winding 1 is configured of a coil 3 which is a group of wires. The coil 3 is configured of a wire 30 wound thereon (see FIG. 4).

The winding 1 is arranged between cylindrical insulation structures (corresponding to those denoted by the reference numeral 400 in FIG. 1). By providing baffles 6*a*, 6*b*, and 6*c* to some places on the winding 1, the mineral oil flows upward in a zigzag manner such that the mineral oil flowing in the outer vertical duct 4*b* flows through the horizontal duct 5 into the inner vertical duct 4*a*, and the mineral oil flowing in the inner vertical duct 4*a* flows through the horizontal duct 5 into the outer vertical duct 4*b*, for example. This means that in an area between neighboring baffles 11A on the lower side of FIG. 2, the mineral oil almost flows from right to left, and in an area between neighboring baffles 11B on the upper side, the mineral oil almost flows from left to right. Due to the zigzag flow, the coil 3 can be cooled efficiently.

In the present invention, in order to make the flow velocity of the mineral oil uniform in the respective horizontal ducts 5, in the area between neighboring baffles 11A, a vertical duct opposite to the outer vertical duct 4*b* where an opening 7*a* locates, that is, the inner vertical duct 4*a*, is provided with inner adjustment members 8*a*. Meanwhile, in the area between neighboring baffles 11B, the outer vertical duct 4*b* opposite to the inner vertical duct 4*a* where an opening 7*b* locates, is provided with outer adjustment members 8*b*. In the present embodiment, while two pieces of adjustment members are provided on both the inner side and the outer side, the number of the adjustment members may be increased or reduced in consideration of the number of coils included in the area between neighboring baffles.

In the vertical sectional view of FIG. 2, the neighboring coils 3 are kept at a predetermined interval. The method of keeping it will be described with use of FIG. 3.

Figure 3:
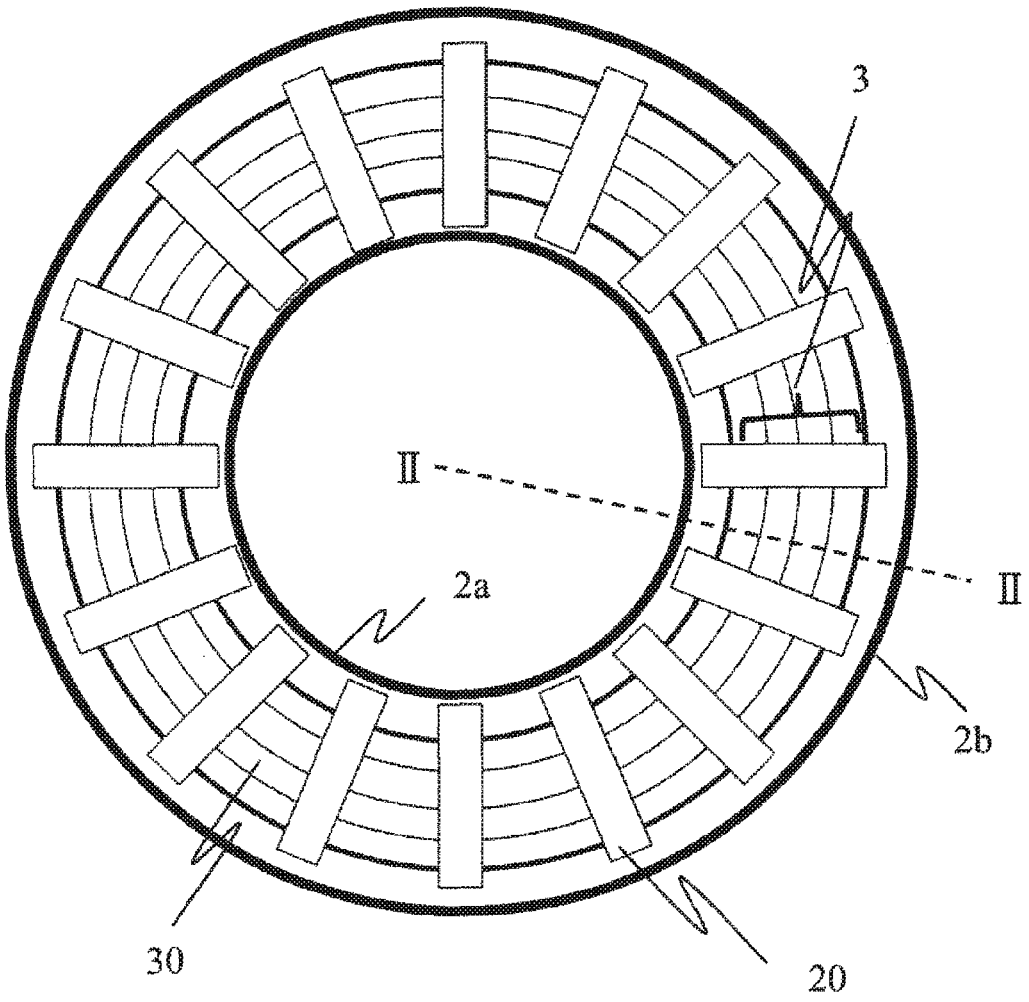
FIG. 3 is a horizontal sectional view of a winding.

FIG. 3 is a horizontal sectional view of a winding. By winding the wire 30 a plurality of times so as to be adjacent to each other in a radial direction, the coil 3 in the lower stage is formed. After arranging horizontal spacers 20 on the coil 3 so as to have equal intervals in a circumferential direction, and winding the wire 30 in the same manner as described above, the coil 3 in the upper stage is formed. By repeating this step, the winding 1 is formed.

By adjusting the thickness of the horizontal spacers 20, an interval between the coils 3 stacked in a vertical direction can be set to have a predetermined value. The coils 3 constitute a cooling channel between an inner cylindrical insulation structure 2*a* and an outer cylindrical insulation structure 2*b*.

Next, a method of fixing the inner adjustment member 8*a* and the outer adjustment member 8*b* will be described with use of FIGS. 4 to 7.

Figure 4:
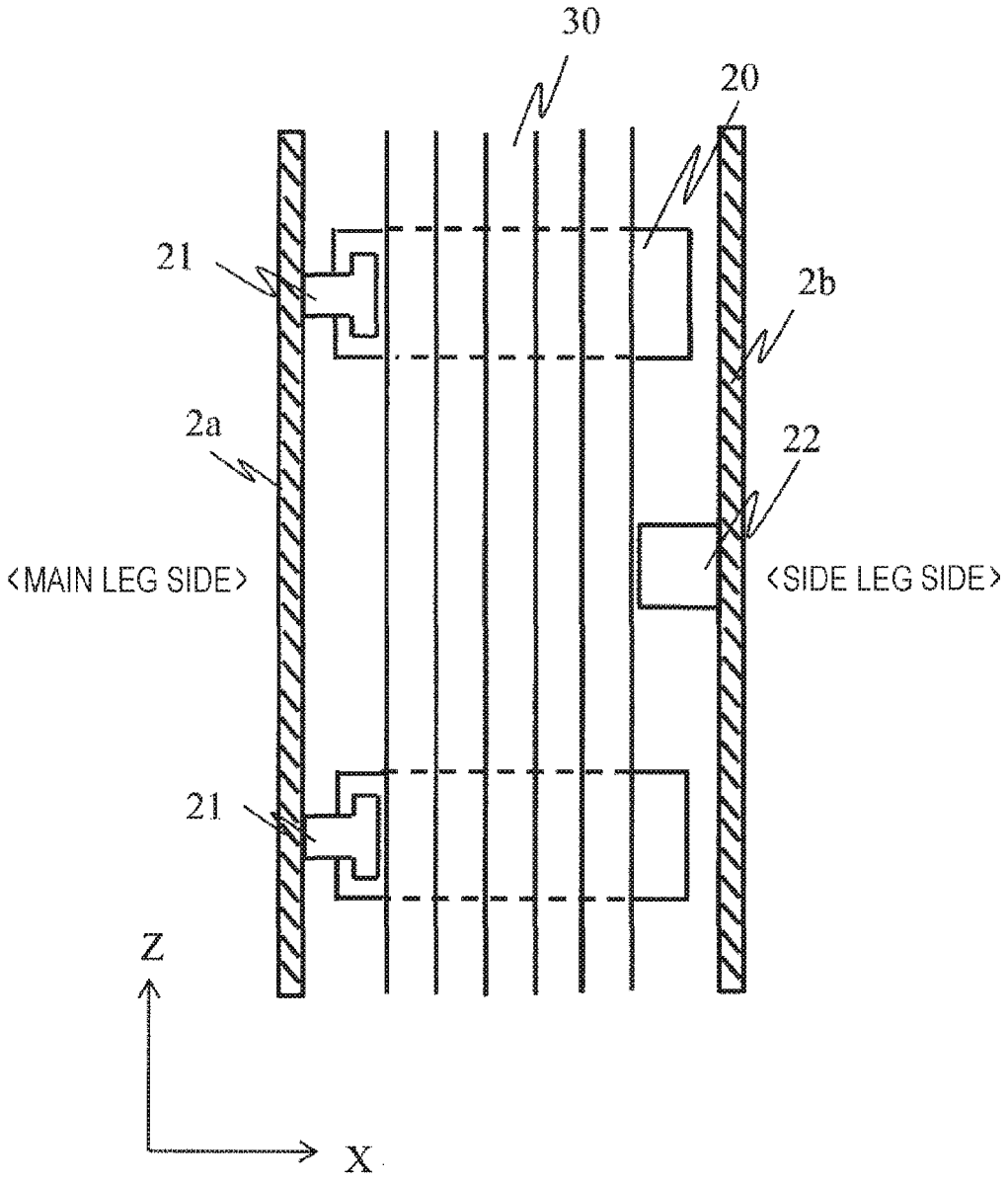
FIG. 4 is a horizontal sectional view of a cross section including a wire 30, according to the first embodiment.

FIG. 4 is a horizontal sectional view of a cross section including the wire 30 (view of IV-IV section of FIG. 2 seen from the above). It should be noted that while both the inner cylindrical insulation structure 2*a* and the outer cylindrical insulation structure 2*b* are actually in a circular shape, they are shown by straight lines for simplification. This also applies to other horizontal sectional views.

The inner cylindrical insulation structure 2*a* is provided with inner vertical spacers 21 arranged at predetermined intervals. An end of the horizontal spacer 20 is processed to have a shape capable of being fitted into the inner vertical spacer 21. After the wire is arranged in a radial direction, the horizontal spacer 20 is inserted to keep a predetermined distance from the wire arranged above, to thereby form the horizontal duct 5. By using the inner vertical spacer 21 and the horizontal spacer 20, the wire 30 is wound, whereby the coil 3 is formed. A structure of pressing the wire 30 (and the coil 3 configured by it) from the outside by the outer vertical spacer 22 is realized.

Figure 5:
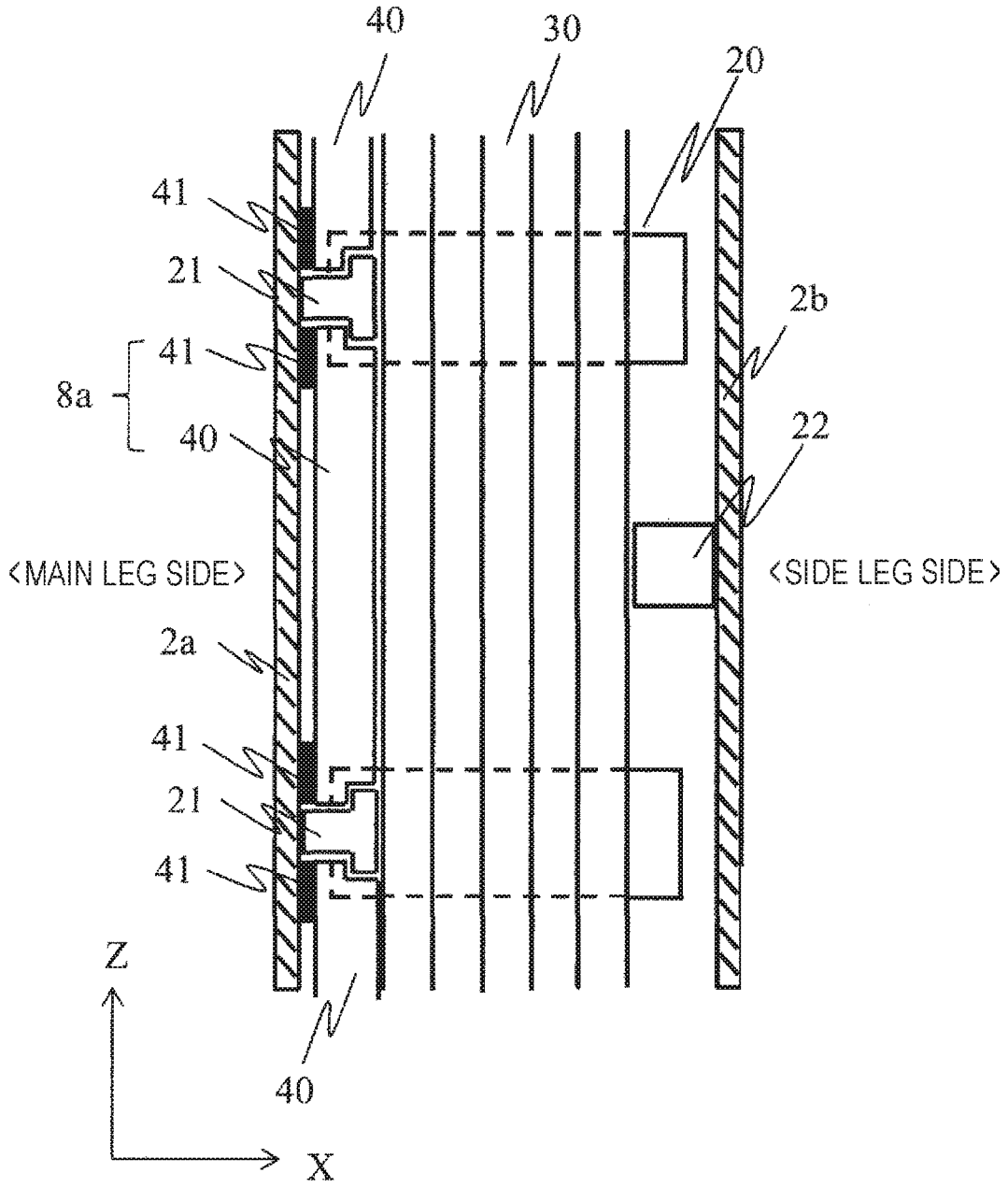
FIG. 5 is a horizontal sectional view of a cross section including an inner adjustment member 8*a*, according to the first embodiment.

FIG. 5 is a horizontal sectional view of a cross section including the inner adjustment member 8*a* (view of V-V section of FIG. 2 seen from the above). The inner adjustment member 8*a* is produced by bonding a gap keeping member 41 to an inner adjustment member base 40. They are produced using a press board, for example. The height of the inner adjustment member base 40 is set to be almost equal to the height of the wire. Depending on the thickness (3 mm, for example) of the gap keeping member 41, the gap size with the inner cylindrical insulation structure 2*a* can be set to a predetermined value. The inner adjustment member 8*a* is inserted between the neighboring inner vertical spacers 21, and is fixed by the wire 30 and the outer vertical spacer 22 arranged in a radial direction. The inner adjustment member 8*a* is sandwiched by the horizontal spacers 20, whereby the position thereof in the vertical direction can be fixed.

Figure 6:
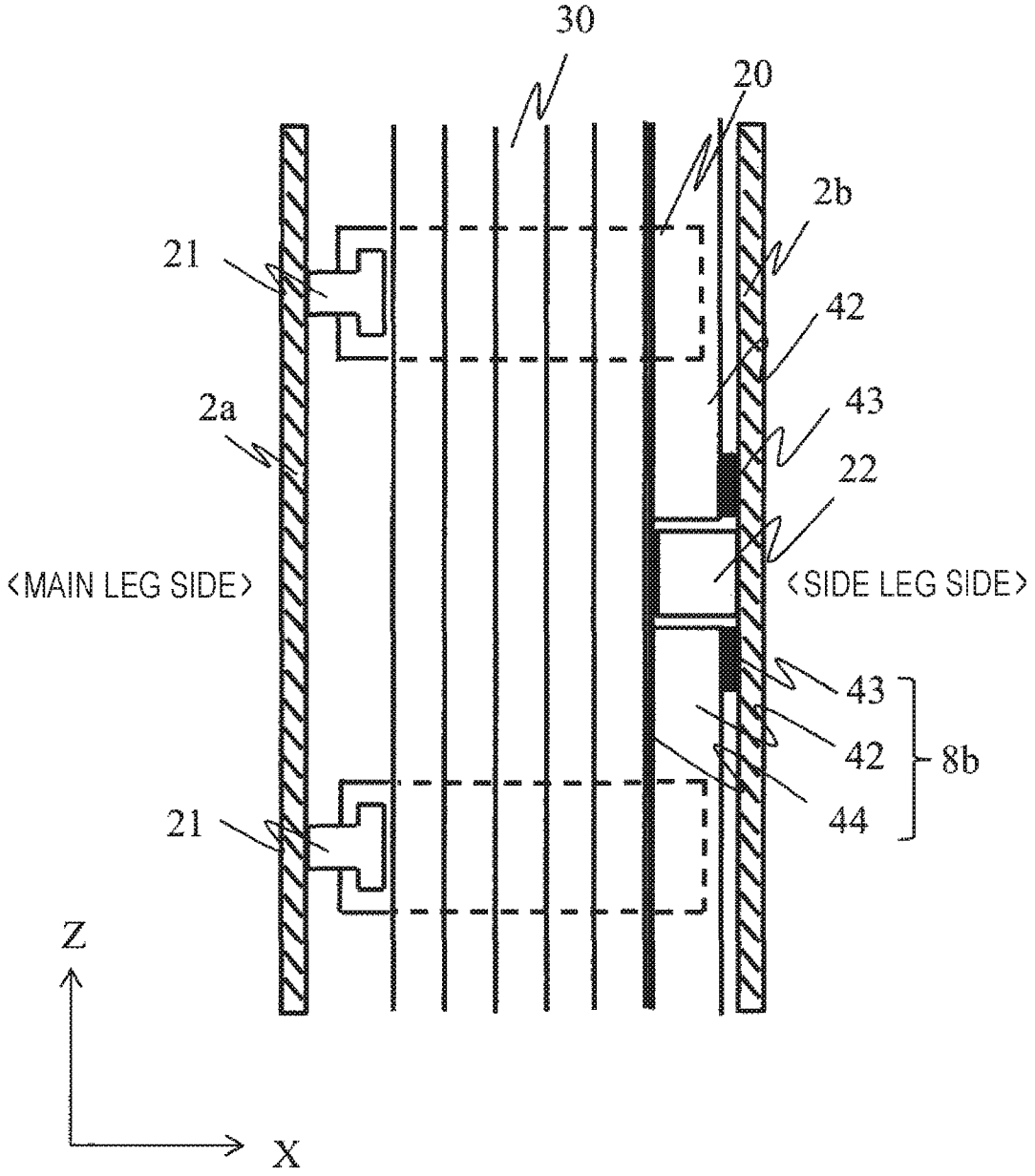
FIG. 6 is a horizontal sectional view of a cross section including an outer adjustment member 8*b*, according to the first embodiment.

FIG. 6 is a horizontal sectional view of a cross section including the outer adjustment member 9*b* (view of VI-VI section of FIG. 2 seen from the above). The outer adjustment member 8*b* is formed by bonding the outer adjustment member base 42, to which the gap keeping member 43 is bonded, to the base linking member 44. They are produced using a press board and an insulating paper, for example.

Figure 7:
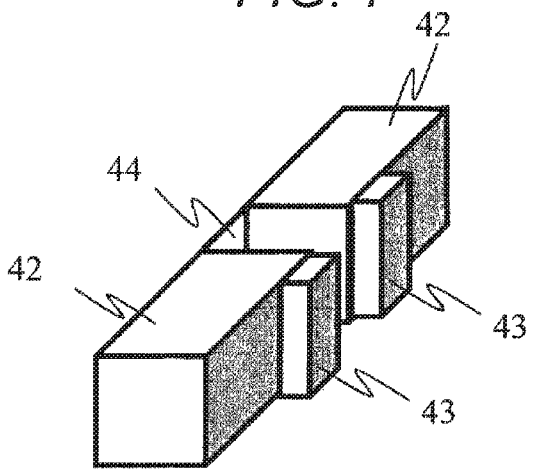
FIG. 7 is a perspective view of the outer adjustment member according to the first embodiment.

FIG. 7 is a perspective view of the outer adjustment member 8*b* illustrated in FIG. 6. Depending on the thickness (3 mm, for example) of the gap keeping member 43, the gap size with the outer cylindrical insulation structure 2*b* can be set to a predetermined value.

After the wire 30 is wound predetermined number of times, the outer adjustment member 8*b* is attached to the outer periphery thereof. The outer adjustment member 8*b* is pressed toward the inner diameter side by the outer vertical spacer 22 and is fixed. The outer adjustment member 8*b* is sandwiched by the horizontal spacers 20, whereby the position thereof in the vertical direction can be fixed.

Figure 8:
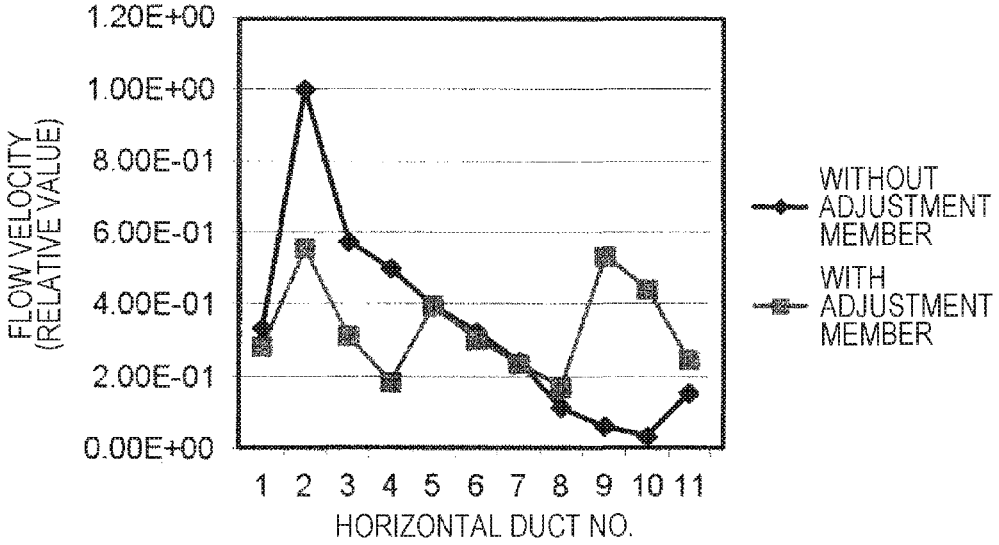
FIG. 8 is a graph of flow velocity distribution illustrating an effect of the first embodiment.

Next, action of the present embodiment will be described with reference to FIGS. 2 and 8.

The coil 3 is cooled by the mineral oil flowing through the horizontal duct 5 (see FIG. 1). As the flow velocity of the mineral oil is higher, the cooling effect becomes higher. FIG. 8 illustrates flow velocity distribution in the respective horizontal ducts in an area between neighboring baffles. In FIG. 8, flow velocities are plotted for the cases where there is an adjustment member (see FIG. 2) and not. The horizontal duct numbers are given sequentially from bottom to top.

When cooling a self-cooling transformer winding, when there is no adjustment member, it is understood that the flow velocity of the mineral oil in several horizontal ducts located above the baffle 6*a* or the like is high, but the flow velocity is lowered significantly in the horizontal ducts located upper.

On the other hand, when there is an adjustment member, assuming that the maximum flow velocity without an adjustment member is 1, the flow velocity in respective portions takes 0.2 to 0.6. This means that flow velocity distribution is made uniform. Consequently, it is possible to reduce the maximum temperature rise (relative to the surrounding oil temperature) in the winding when there is an adjustment member, to almost 40% of the case without an adjustment member.

Next, grounds for the result described above will be described with reference to FIG. 2.

In the case of no inner adjustment member, as a large amount of the mineral oil, entering from the opening 7*a*, flows into the first to the fourth horizontal ducts 5 from the bottom, the flow rate of it flowing into the horizontal ducts above them becomes significantly less.

Meanwhile, by providing the inner adjustment member 8*a*, as the pressure loss is increased in the gap portion formed by the inner adjustment member 8*a*, the flow velocity in the horizontal ducts 5 downstream of the inner adjustment member 8*a* is lowered, compared with the case of no inner adjustment member. Along with it, as the amount of mineral oil flowing upward in the outer vertical duct is increased, the flow velocity in the horizontal ducts 5 above the inner adjustment member 8*a* also becomes higher. A similar effect is also achieved for the second inner adjustment member 8*a*. In this way, the flow velocity of the mineral oil in the respective horizontal ducts 5 in the area between neighboring baffles can be made uniform.

Second Embodiment

In the present embodiment, the case of using a blockage member, instead of a baffle, will be described.

Figure 9:
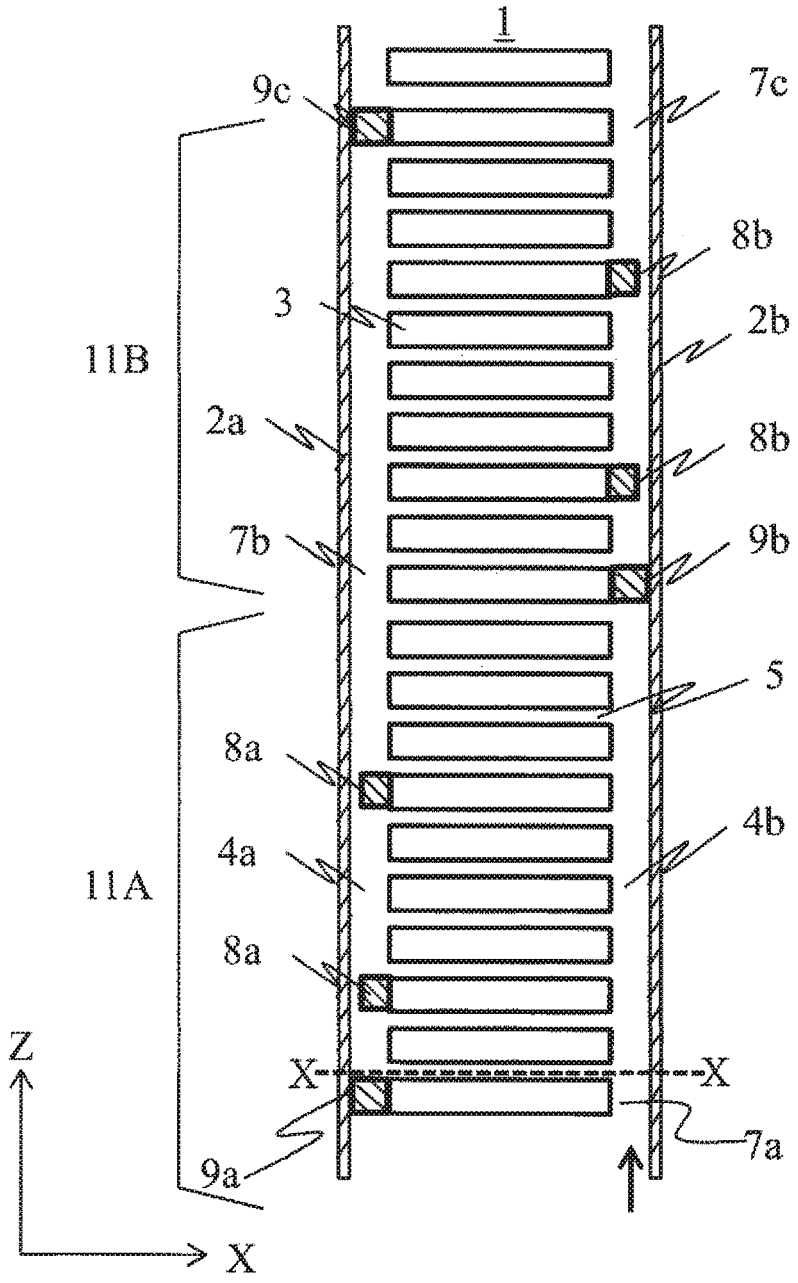
FIG. 9 is a vertical sectional view illustrating a winding cooling structure according to a second embodiment.

FIG. 9 is a vertical sectional view illustrating a winding cooling structure in the present embodiment. The winding cooling structure of the present embodiment is almost similar to that of the winding cooling structure in FIG. 2, except that blockage members 9*a*, 9*b*, and 9*c* are provided instead of the baffles 6*a*, 6*b*, and 6*c*. With the blockage members 9*a*, 9*b*, and 9*c*, an effect of mostly blocking the flow of mineral oil flowing upward in the inner vertical, duct 4*a* and the outer vertical duct 4*b* is achieved.

Next, a method of mounting a blockage member will be described.

Figure 10:
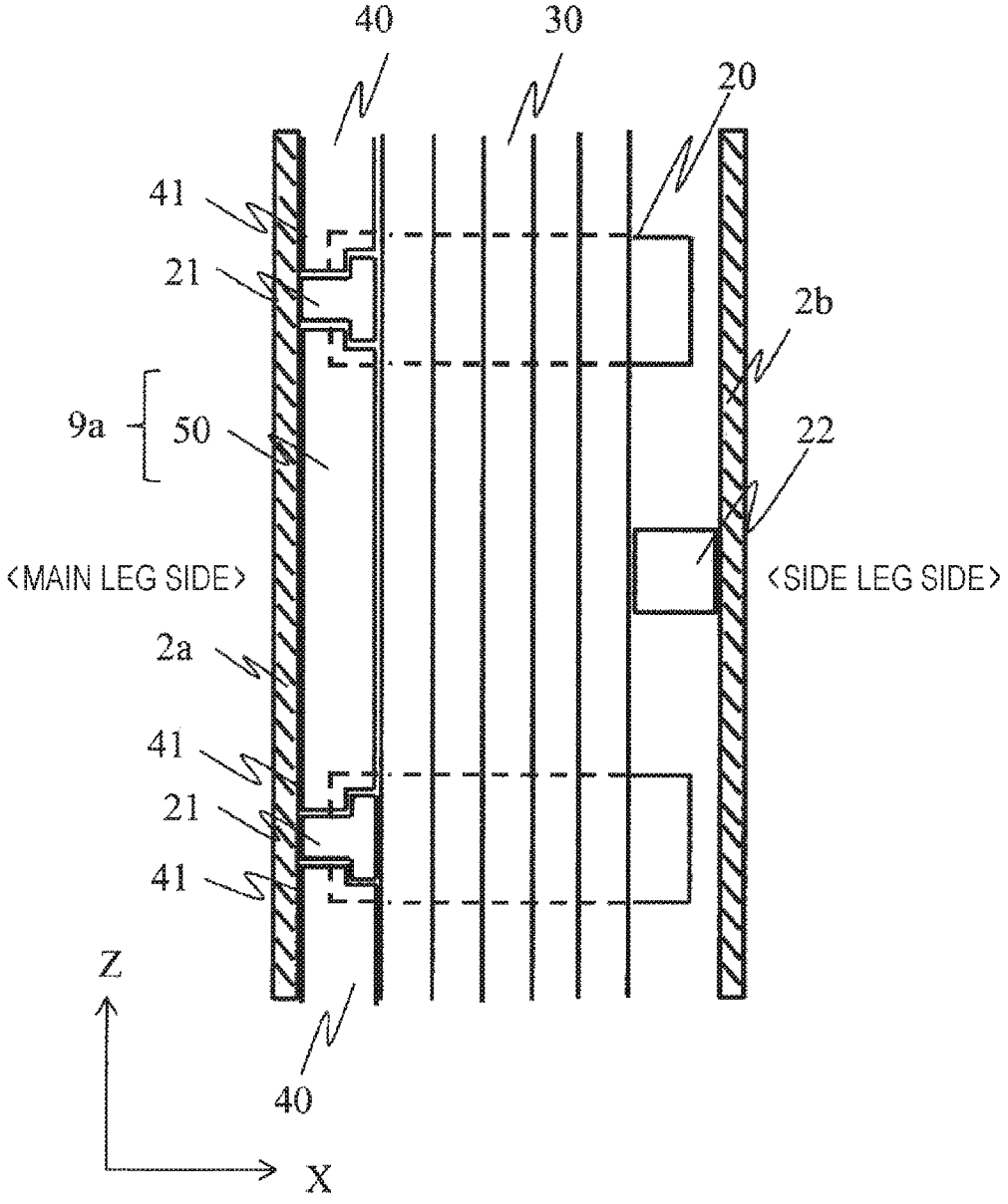
FIG. 10 is a horizontal sectional view of a cross section including a blockage member 9*a*, according to the second embodiment.

FIG. 10 is a horizontal sectional view of a cross section including a blockage member (view of X-X section of FIG. 9 seen from the above). Descriptions of those having the same functions as the structures denoted by the same reference numerals in FIG. 2 are omitted herein.

In the present embodiment, a blockage member 9*a* can be fitted between the neighboring inner vertical spacers 21, and is configured by arranging a blockage member unit 50, covering the entire inner vertical duct 4*a*, in a circumferential direction. The blockage member unit 50 can be fixed firmly by being sandwiched by the horizontal spacers 20. Accordingly, it has the same effect as that of the baffle 6*a*. A method of assembling the blockage member unit 50 is almost similar to the method of assembling the inner adjustment member 8*a* and the outer adjustment member 8*b*, and has an effect that assembling work can be easier than the case of using a baffle.

Third Embodiment

In the present embodiment, description will be given on the case where a gap, formed by an inner adjustment member and an outer adjustment member, is provided on the wire 30 side.

Figure 11:
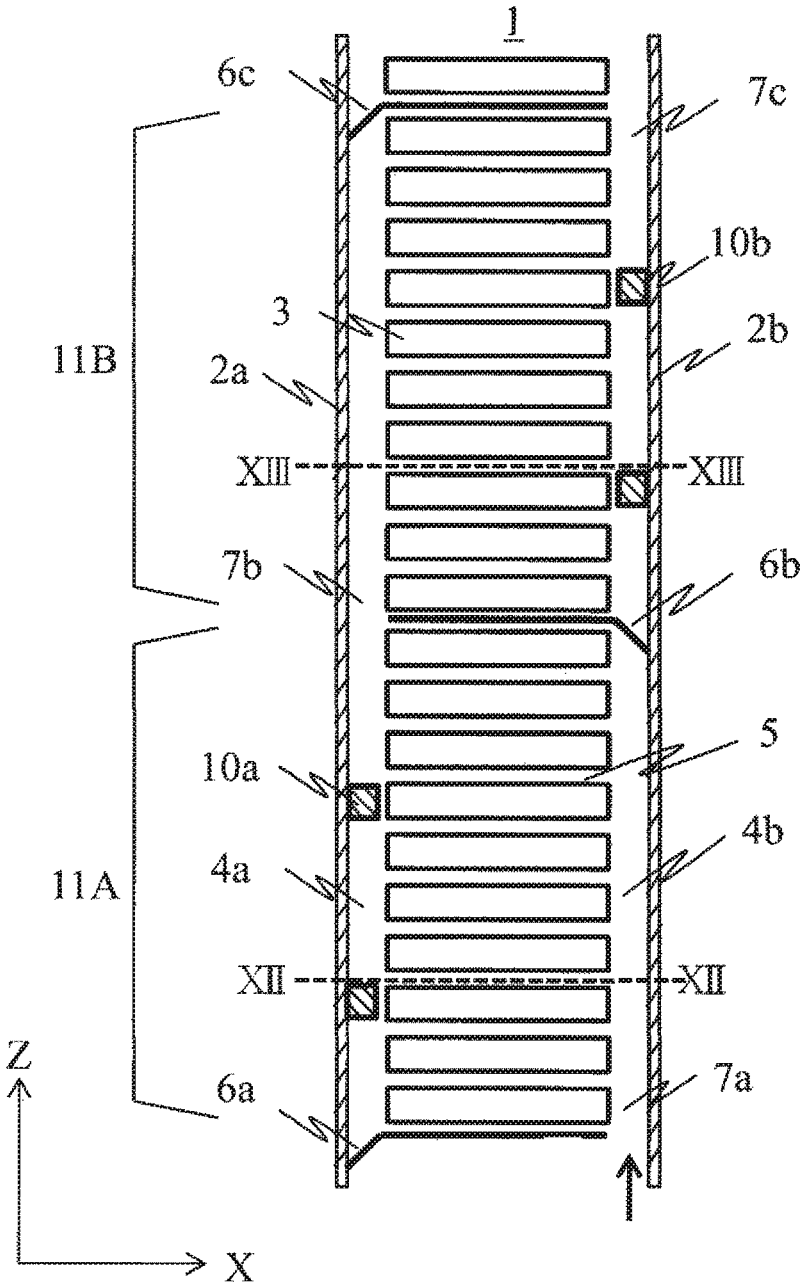
FIG. 11 is a vertical sectional view illustrating a winding cooling structure according to a third embodiment.

FIG. 11 is a vertical sectional view of a winding cooling structure in the present embodiment. The winding cooling structure of the present embodiment is almost similar to that of FIG. 2, except that while, in the embodiment of FIG. 2, a gap between the inner adjustment member 8*a* and the outer adjustment member 8*b* is provided on the inner cylindrical insulation structure 2*a* or the outer cylindrical insulation structure 2*b* side, in the present embodiment, a gap between a second inner adjustment member 10*a* and a second outer adjustment member 10*b* is formed on the coil 3 side.

Next, a method of fixing the second inner adjustment member 10*a* and the second outer adjustment member 10*b* will be described with use of FIGS. 12 to 14.

Figure 12:
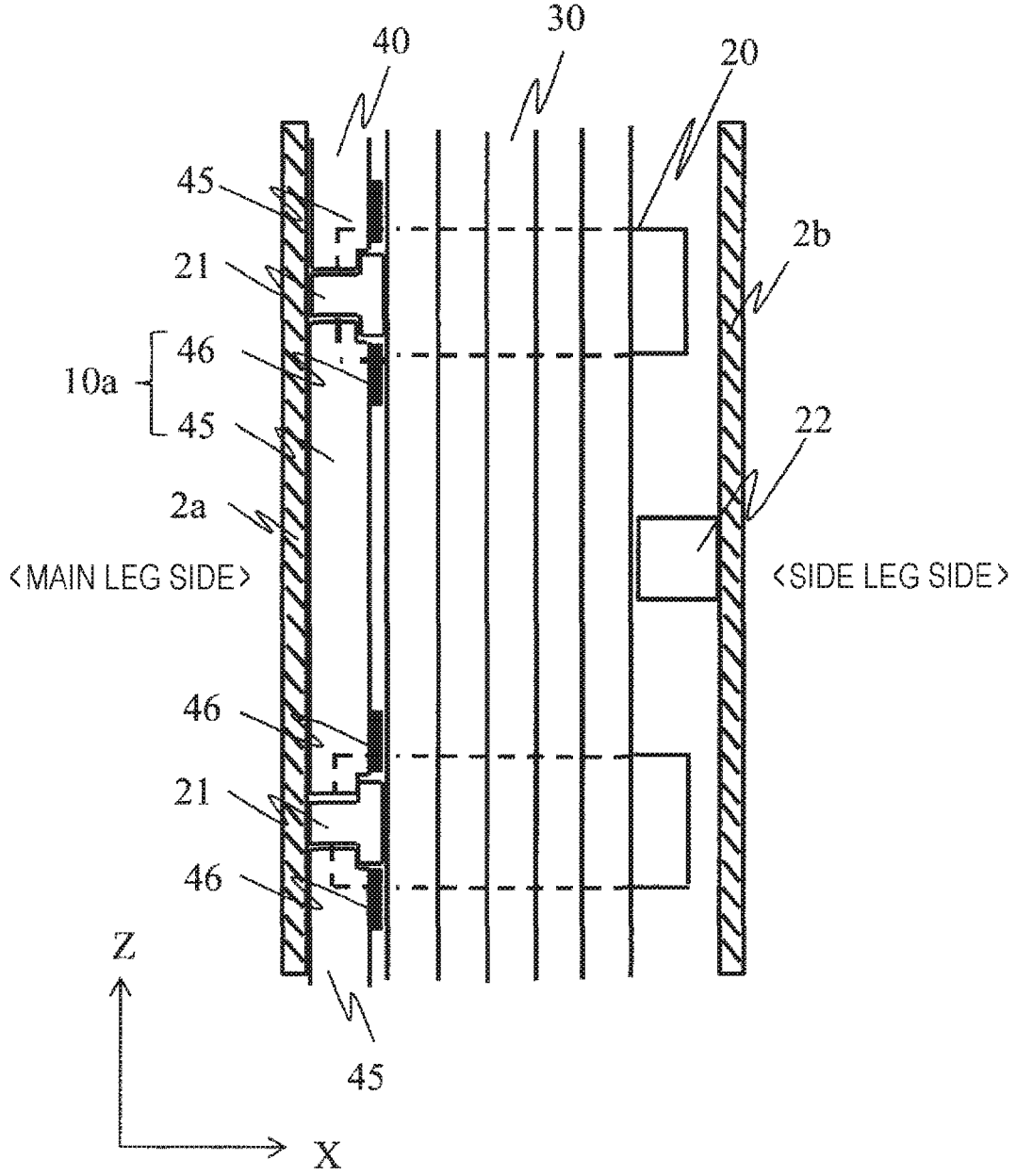
FIG. 12 is a horizontal sectional view of a cross section including a second inner adjustment member 10*a*, according to the third embodiment.

FIG. 12 is a horizontal sectional view of a cross section including the second inner adjustment member 10*a* (view of XII-XII section in FIG. 11 seen from the above). The second inner adjustment member 10*a* is produced by bonding a gap keeping member 46 to a second inner adjustment member base 45. They are produced using a press board, for example. The second inner adjustment member base 45 is arranged at a height almost similar to that of the wire 30. Depending on the thickness of the gap keeping member 46 (3 mm, for example), the gap size with the wire 30 on the inner diameter side can be set to a predetermined value. The second inner adjustment member 10*a* is inserted between the neighboring inner vertical spacers 21, and is fixed by the wire 30 and the outer vertical spacer 22 arranged in a radial direction. The second inner adjustment member 10*a* is sandwiched by the horizontal spacers 20, whereby the position thereof in the vertical direction can be fixed.

Figure 13:
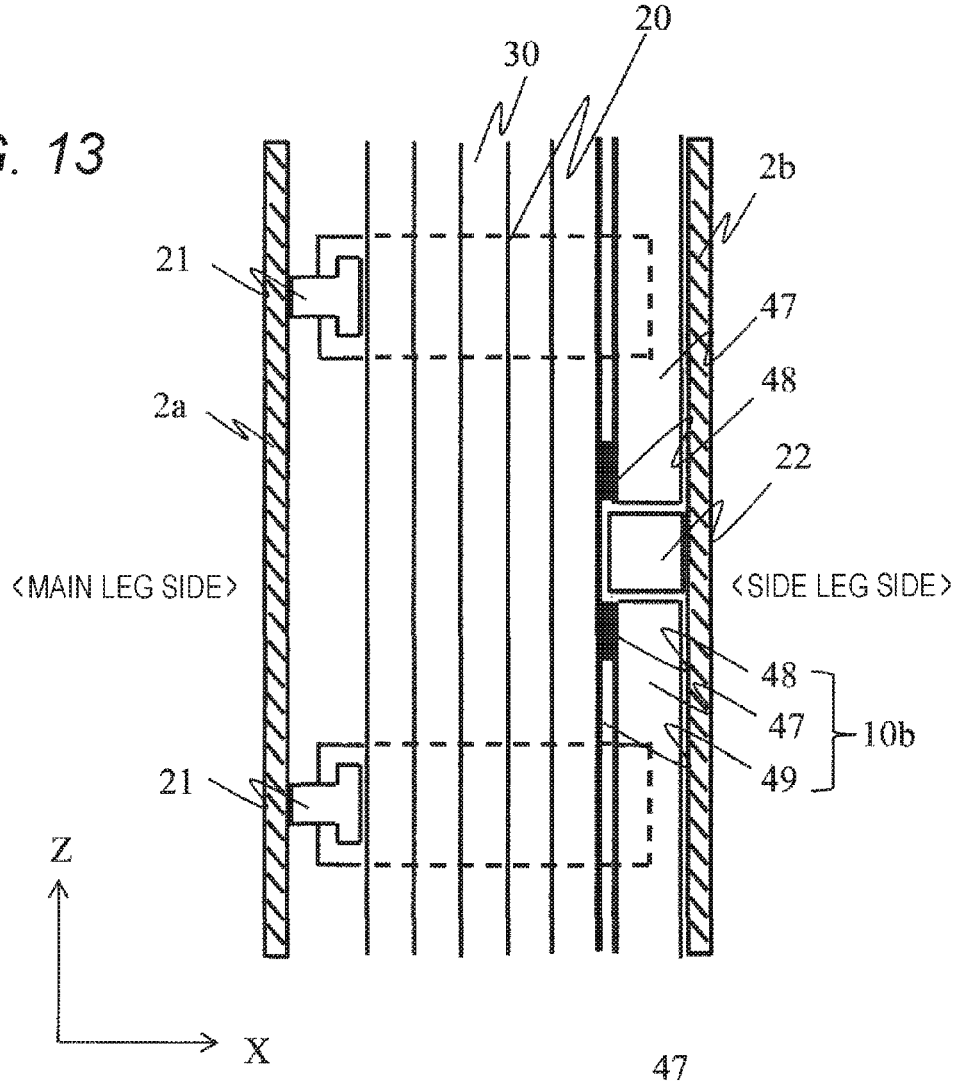
FIG. 13 is a horizontal sectional view of a cross section including a second outer adjustment member 10*b*, according to the third embodiment.
Figure 14:
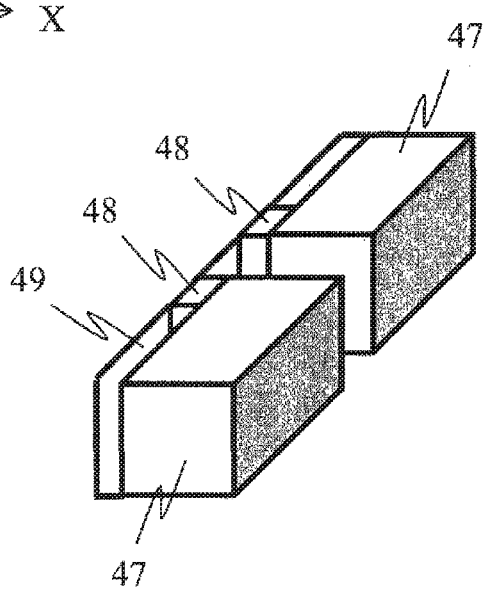
FIG. 14 is a perspective view of the second outer adjustment member according to the third embodiment.

FIG. 13 is a horizontal sectional view of a cross section including the second outer adjustment member 10*b* (view of XIII-XIII section in FIG. 11 seen from the above).

The second outer adjustment member 10*b* is formed by bonding a second outer adjustment member base 47, to which a gap keeping member 48 is bonded, to a base linking member 49. They are produced using a press board and an insulating paper, for example. FIG. 14 is a perspective view of the second outer adjustment member 10*b*. Depending on the thickness (3 mm, for example) of the gap keeping member 48, the gap size with the wire 30 on the outermost periphery can be set to a predetermined value. The second outer adjustment member 10*b* is arranged around the wire on the outermost periphery, and is fixed by the outer vertical spacer 22. The second outer adjustment member 10*b* is sandwiched between the horizontal spacers 20, whereby the position thereof in the vertical direction can be fixed.

With the winding cooling structure illustrated in FIG. 11, the flow velocity of the mineral oil in the respective horizontal ducts 5 can be made uniform in the area between neighboring baffles, as similar to the embodiment of FIG. 2, and the maximum temperature rise in the winding can be lowered. The present embodiment has an advantage that a temperature rise in the wire adjacent to the second inner adjustment member 10*a* and the second outer adjustment member 10*b* can be suppressed to be low.

The present invention is not limited to the embodiments described above. For example, the embodiments described above are detailed description of the present invention for the purpose of easy understanding, and the present invention is not limited to that having the entire configurations described above. Further, part of a configuration of any of the embodiments may be replaced with another embodiment, and a configuration of any of the embodiments may be added to a configuration of another embodiment. It should be noted that while a transformer has been described as an embodiment, the present invention is also applicable to a stationary induction electric apparatus such as an iron-core reactor.

What is claimed is:

1. A stationary induction electric apparatus comprising:

an iron core having legs of core and yokes of core;

windings wound around the legs of core;

coolant for cooling the windings;

a cylindrical insulation structure that forms a flow of the coolant around the windings;

baffle members alternately provided on the inner wall side and the outer wall side of the cylindrical insulation structure;

a plurality of inner vertical spacers arranged between the cylindrical insulation structure and the windings;

adjustment members for constricting the flow of the coolant, the adjustment members being provided on the same side of the respective baffle members and on the respective baffle members;

wherein each of the adjustment members includes:

an adjustment member base having a circular shape and being arranged between the cylindrical insulation structure and the windings; and a gap keeping member for adjusting a gap between the adjustment member base and the windings or a gap between the adjustment member base and the cylindrical insulation structure.

2. The stationary induction electric apparatus according to claim 1, wherein each of the baffle members is a blockage member.

* * * * *